US005813184A

United States Patent [19]

McKenna

[11] Patent Number: 5,813,184

[45] Date of Patent: Sep. 29, 1998

[54] HEATED SERIALLY CONNECTABLE ROOFING SHINGLES

[76] Inventor: David J. McKenna, P.O. Box 8031, Breckenridge, Colo. 80424

[21] Appl. No.: 855,450

[22] Filed: May 13, 1997

[51] Int. Cl.[6] ..... E04D 1/22; E04D 1/28

[52] U.S. Cl. ..... 52/518; 52/520; 52/522; 52/527; 52/543

[58] Field of Search ..... 52/518, 527, 520, 52/519, 522, 543; 219/213

[56] References Cited

U.S. PATENT DOCUMENTS

| | | | |
|---|---|---|---|
| 2,546,743 | 3/1951 | Harrison . | |
| 2,699,484 | 1/1955 | Michaels . | |
| 3,129,316 | 4/1964 | Glass et al. . | |
| 3,214,565 | 10/1965 | Hager, Jr. et al. | 219/213 X |
| 3,431,972 | 3/1969 | Bernardi . | |
| 3,445,628 | 5/1969 | Bateman, Sr. | 219/213 X |
| 3,691,343 | 9/1972 | Norman . | |
| 3,806,702 | 4/1974 | Spencer | 219/213 X |
| 4,040,867 | 8/1977 | Forestieri et al. | 52/518 X |
| 4,051,466 | 9/1977 | Protze | 219/213 X |

*Primary Examiner*—Christopher Kent
*Attorney, Agent, or Firm*—Terrance L. Siemens

[57] ABSTRACT

Self-heating roofing construction elements containing a heating element embedded therein. Each construction element has at least one tab extending laterally, the tab enclosing one or more electrical conductors so that one construction element may be connected by snap fit to an adjacent construction element. Preferably, the elements are provided as a kit including a right side end module, one or more center modules, and a left side module. Individual construction elements may be ceramic tiles, wood shake shingles, or asphaltic shingles, preferably reinforced with recycled glass, recycled rubber, or both. Whether one or plural modules, the construction element is controlled by an electrical controller responsive to subfreezing temperatures and to presence of precipitation.

4 Claims, 4 Drawing Sheets

HEATED SERIALLY CONNECTABLE ROOFING SHINGLES

BACKGROUND OF THE INVENTION

1. Field of the Invention

The present invention relates to roofing shingles having internal heating elements. More particularly, each shingle has structure for electrically connecting to one or two adjacent similar shingles. The invention includes a sensor for controlling electrical power to the heating elements when subfreezing temperatures and precipitation are present.

2. Description of the Prior Art

Buildings having pitched roofs located in areas of high snow fall and other frozen precipitation are susceptible to damage occurring as the precipitation accumulates. Expansion of ice and infiltration of melted water can force its way between conventional roofing shingles and pass into occupied space in the building. This problem can be extreme in some areas wherein snowfall may total more than ten feet per year.

Beyond enabling frozen or liquid water to infiltrate to the interior of the affected building, accumulations of ice and other forms of water impose great weight loads on roofs. Although the building may be built to withstand such loads, the accumulation presents hazards due to falling ice and snow. This may occur when the weight of a frozen formation exceeds its ability to adhere to the roof, or may occur due to partial melting.

The prior art has proposed various electrical heaters for mitigating frozen accumulations on roofs. Heated roofing shingles are shown in U.S. Pat. No. 2,546,743, issued to Joseph L. Harrison on Mar. 27, 1951. Harrison's shingles are electrically connected to an electrical source by an electrical supply bus separate from the shingle. By contrast, electrical conductors of the shingles of the present invention pass through tabs for snap fitting to an adjacent shingle, and thus form a modular assembly. The shingles of Harrison lack the automatic control system of the present invention.

A modular heated roofing shingle system is shown in U.S. Pat. No. 3,691,343, issued to Victor B. Norman on Sep. 12, 1972. Individual shingles in this invention are connected in parallel from a supply bus which must span connected shingles, unlike the present invention. Norman's shingles are formed from sheet metal, rather than having conventional construction of roofing shingles. By contrast, the present invention retains the appearance of conventional shingles for aesthetic purposes. Norman's device lacks the automatic control system of the present invention.

U.S. Pat. No. 3,129,316, issued to Ferris N. Glass et al. on Apr. 14, 1964, describes an electrically heated mat which may be placed between adjacent layers of a roof. U.S. Pat. No. 3,431,972, issued to Oscar Bernardi on Mar. 11, 1969, describes a heated dam for preventing ice and the like from sliding off a pitched roof. The devices of Glass et al. and Bernardi stand alone, rather than cooperating in modular fashion with similar devices, and are not roofing shingles, unlike the present invention.

U.S. Pat. No. 2,699,484, issued to Herbert L. Michaels on Jan. 11, 1955, describes a heating device intended for installation at the lowest edge of a pitched roof. This device is not a shingle and lacks the control system of the present invention.

None of the above inventions and patents, taken either singly or in combination, is seen to describe the instant invention as claimed.

SUMMARY OF THE INVENTION

The present invention provides modular roofing shingles which are connected at right and left lateral sides to similar roofing shingles. Each shingle has an electric heating element which connects to a neighboring heating element. The shingles are generally of conventional constituent materials apart from the electric heater and tabs which enable one shingle to be fastened and electrically connected to an adjacent shingle. The self-heating nature of the novel shingles is thus concealed, so that the architectural aesthetic effect of a conventional roof is preserved.

The modular shingles form a self-contained section of shingles wherein electrical power is conducted within each shingle to each succeeding shingle. Separate external supply busses and associated connections are eliminated, as well as attendant complexity, weight, cost, and potential for failure. Obtrusiveness is also mitigated by this construction. This is an advantage where it is desired that heated shingles not interrupt the uniform appearance of the roof as a whole.

The material of each shingle is asphaltic, with granular solid materials embedded at least in the upper surface for additional mechanical resistance to erosion and impacts. Preferably, commuted glass or rubber or both are mixed into the asphaltic or other conventional base material. The glass and rubber materials may be taken from recycled post-consumer products, and will reinforce the shingle and reduce reliance upon virgin base material.

The heating element is embedded within the shingle, and may comprise any suitable known electrical resistance material. A solid conductor projects from each side of the shingle for connection to a neighboring shingle, where series connection of heating elements is desired. This conductor forms part of a tab which engages a corresponding tab of an adjacent shingle. Alternatively, the heating element may include two supply busses with many resistive sub circuits occurring along the length of the two busses, as is well known in the field of self-limiting heating cables. Each shingle has two tabs, one on each lateral side. Each tab has one or two electrical connecting conductors, depending upon the type of heating element, comprising a metallic male or female member which snap fits to an opposite type connector disposed upon an adjacent tab. Mating tabs overlap, so that the shingles can be adjusted to abut in conventional fashion, and so that the electrical connection is covered by a weather resistant member. This connection enables assembly by personnel who may not be skilled in electrical construction.

Alternatively, the invention may comprise wood shake shingles and ceramic tiles configured as their conventional counterparts, but provided with electrical heating elements and tab connectors.

Connection of electrical power to the modular assembly is controlled by the following arrangement. A thermostatic control and a water detector are disposed in series. This assures that electric power is connected to the heating shingles only when conditions warrant. The thermostatic control limits power to when subfreezing temperatures are encountered. The water detector permits power to be connected only when precipitation is present. With both conditions being required for power, the novel assembly is fully automatically controlled to operate only when appropriate. This scheme represents an improvement over the combination of combined manual and thermostatic switches of prior art systems.

Accordingly, it is a principal object of the invention to provide electrically heated shingles for a roof.

It is another object of the invention to enable uncomplicated electrical connection between adjacent shingles.

It is a further object of the invention to provide overlapping tabs for connecting adjacent shingles.

Still another object of the invention is to connect heating elements or electrical supply busses of the shingles in series without external busses.

An additional object of the invention is to control power to the shingles by monitoring both temperature and presence of precipitation.

It is again an object of the invention to enable ready assembly by personnel unskilled in electrical construction.

Yet another object of the invention is to maintain the appearance of conventional roofing components and materials when the novel shingles are installed on a roof.

A still further object of the invention is to utilize recycled rubber and glass.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
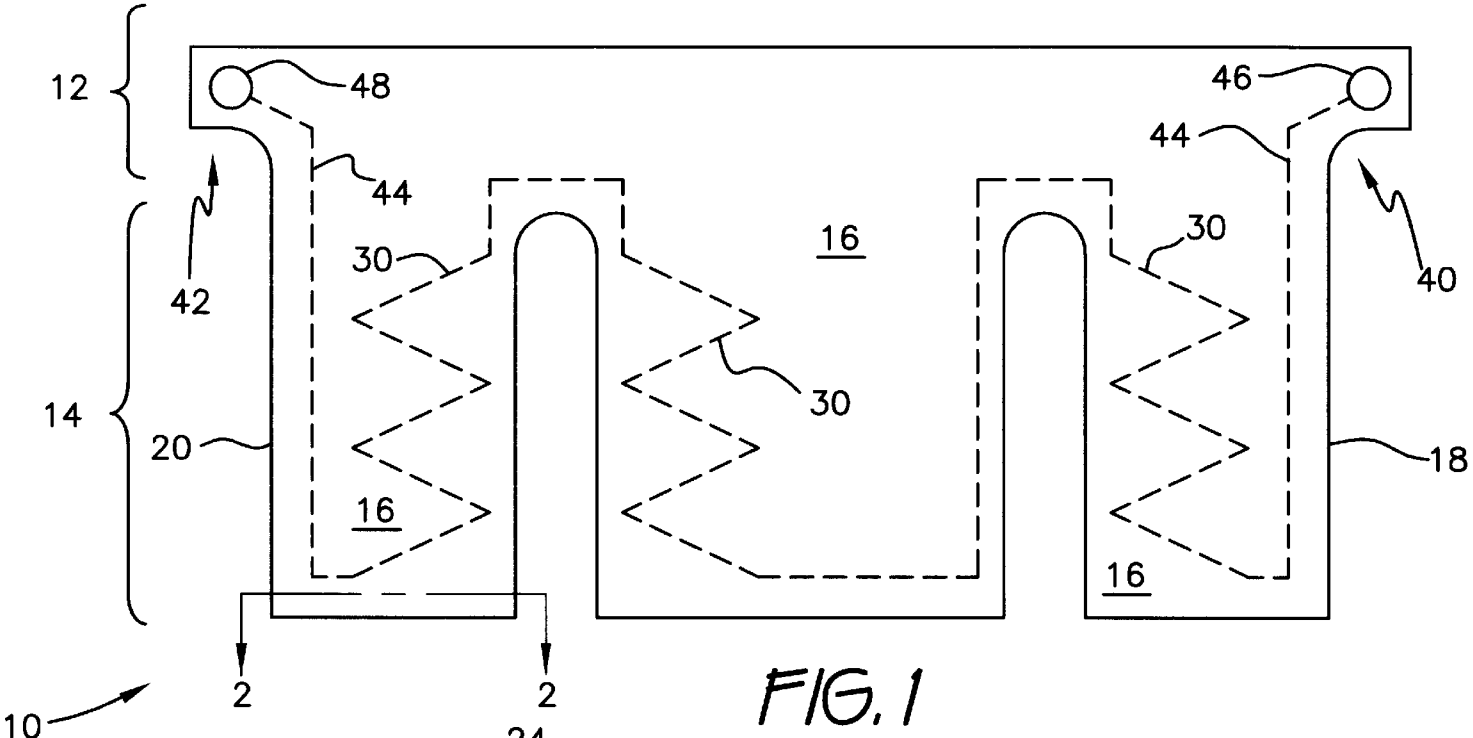
FIG. 1 is a top plan view of a novel construction element, illustrating a first embodiment wherein the novel construction element is an asphaltic shingle.

Turning now to FIG. 1 of the drawings, the basic unit of the invention is seen to comprise a self-heating roofing surface construction element which serves as a weather resistant element of an assembled roof (not shown). The construction element may be a shingle, a tile, or any prefabricated panel which is essentially flat beyond having nominal thickness and which has a weather resistant upper surface.Opposite this weather resistant upper surface is the bottom structural contact surface. In the embodiment of FIG. 1, the construction element is an asphaltic shingle 10. Shingle 10 comprises a body having a configuration generally conventional of asphaltic shingles, including an upper or nailing area 12 for receiving nails (not shown) and a lower area 14 disposed adjacent upper area 12, for providing a weather resistant surface 16.

Figure 2:
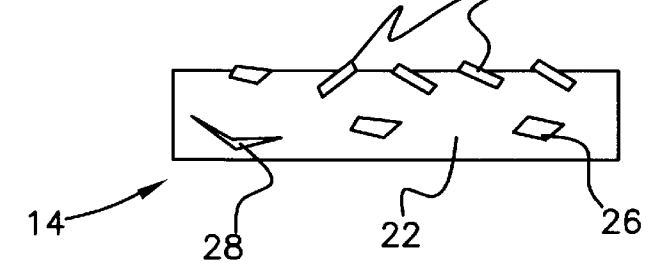
FIG. 2 is a cross sectional view of the novel shingle of FIG. 1, taken along line 2—2 of FIG. 1.

The body of shingle 10 has a right lateral edge 18 and a left lateral edge 20. As seen in FIG. 2, the body of shingle 10 is formed from an asphaltic composition 22 having granular solids 24 embedded therein. Granular solids 24 may permeate asphaltic composition 22 uniformly throughout the depth of the body of shingle 10, or may at a minimum be disposed only on the exposed weather resistant surface 16. Surface 16 is imparted with weather resistant qualities by asphaltic composition 22 and is mechanically reinforced by granular solids 24. The interior of the body of shingle 10 is preferably reinforced by shredded or otherwise commuted recycled rubber 26 or glass 28 or both. Rubber 26, which will be understood to encompass flexible plastics, and glass 28 may be in the form of irregular shards, granules, fibers, or of other configurations.

Returning to FIG. 1, shingle 10 has embedded within its body an electrical heating element 30 disposed in underlying relationship to weather surface 16. Heating element 30 may be continuous or formed in connected sections, and may be of any suitable type. Heating element 30 may be of constant heat output, or may have self-limiting heat output characteristics. Regardless of heating characteristics, heating element 30 may have a self-contained configuration characteristic of self-limiting heating cables (not shown).

Figure 3:
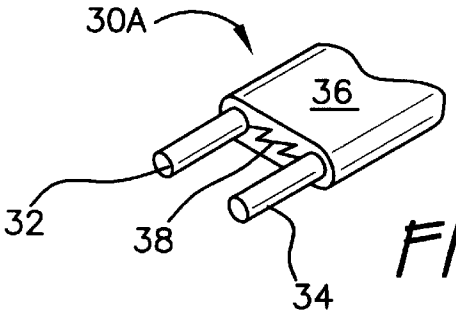
FIG. 3 is a perspective detail view of one embodiment of an electrical heating element used in the invention.

This self-contained configuration is shown in FIG. 3. In this configuration, two electrical supply busses 32, 34, typically formed from stranded metallic wire conductor, are enveloped within a resistive material 36. The resistive portion of the electrical circuit occurs in resistive material 36 between busses 32, 34, and is indicated at 38. This type of heating element 30A provides a continuous zone of resistance so that the effective portion of heating element 30A is configured as a ribbon, rather than as a rod (not shown) typical of resistive wire. Also, supply busses 32, 34 are coextensive with resistive element 36 throughout the body of shingle 10, so that periodic connection of a resistive element to its supply busses is not required.

Again referring to FIG. 1, shingle 10 has two tabs 40, 42 projecting laterally therefrom, one tab 40 or 42 projecting from one lateral side or edge 18 or 20. Each tab 40 or 42 has embedded within at least one electrical conductor 44 connected to one side of heating element 30, for connecting electrical power to heating element 30. Each electrical conductor 44 terminates in both a male terminal 46 and a female terminal 48. The male and female terminal ends 46, 48 are at opposite ends of the electrical conductor 44 and extend through top weather and bottom structural contact surfaces of the shingle 10. Terminals 46, 48 are dimensioned and configured to snap fit to one another.

Figure 4:
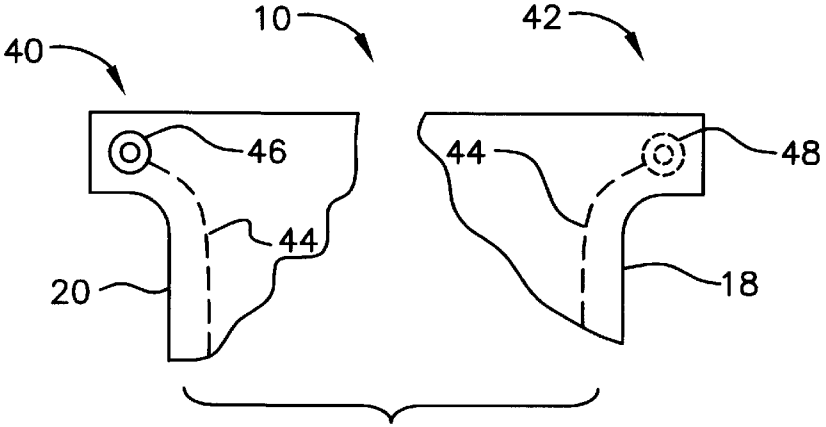
FIG. 4 is a bottom plan detail view of FIG. 1, showing right and left upper corners of the novel shingle.

Turning now to FIG. 4, it will be seen that male terminal 46 is disposed upon the bottom side of tab 40, whereas female terminal 48 is disposed upon the upper side of tab 42. This arrangement assures that plural shingles 10 may be connected in catenated fashion while preserving continuity of the electrical circuitry. Of course, it is not critical as to which terminal 46 or 48 is disposed on the upper side and which on the bottom side.

Figure 5:
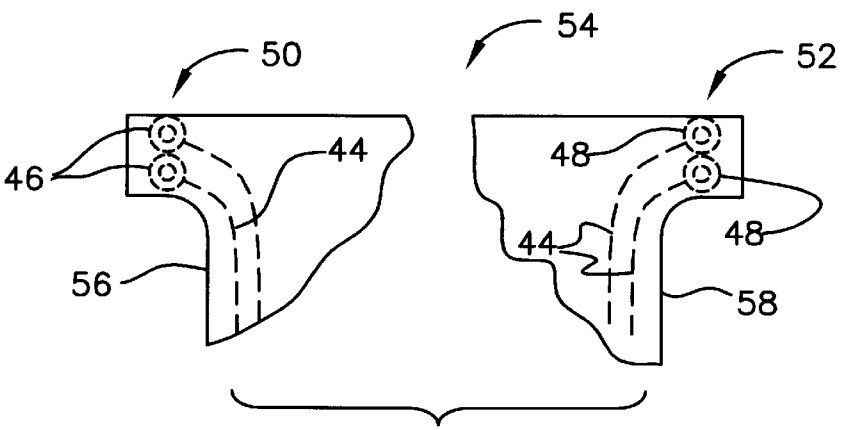
FIG. 5 is a bottom plan detail view similar to that of FIG. 4, but illustrating an alternative embodiment.

As shown in FIG. 5, if heating element 30 is of the self-contained type, then each tab 50, 52 is provided with two terminals 46 and two terminals 48. Two associated conductors 44 pass through the body of shingle 54 to each tab 50 or 52. One of these two associated conductors 44 is connected to bus 32 (see FIG. 3 and the other of two associated conductors 44 is connected to bus 34 (see FIG. 3). In the embodiments of both FIGS. 1 and FIG. 5, conductors 44 are located towards edges 18 and 20 or edges 56 and 58 to avoid unduly intruding upon nailing area 12 (see FIG. 1) or a corresponding nailing area (not shown) of shingle 54. Optionally, indicia (not shown) may be disposed upon the respective nailing area for advising installing personnel of that portion of the nailing area which is safely penetrated by nails.

Figure 6:
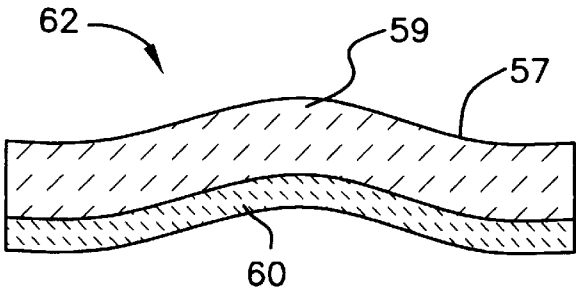
FIG. 6 is a cross sectional view similar to that of FIG. 2, but illustrating an alternative embodiment of the invention wherein the novel construction element is a ceramic roofing tile.

Individual construction elements may take forms other than that of asphaltic shingles 10 and 54. As shown in FIG. 6, the novel construction element may have a body wherein weather resistant material or surface 57 is of ceramic material 58. A separate substrate 60 for covering the heating element (not shown) on its lower surface may be provided. Alternatively, the heating element may be embedded within ceramic material 58. In either case, the resultant construction element will take the form of a ceramic tile 62.

Figure 7:
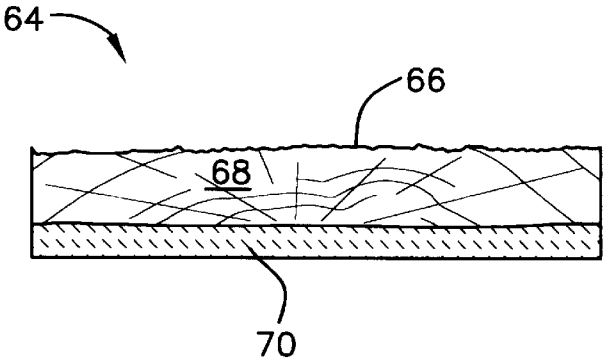
FIG. 7 is a cross sectional view similar to that of FIG. 2, but illustrating an alternative embodiment of the invention wherein the novel construction element is a wooden shake shingle.

In a further variation shown in FIG. 7, the novel construction element may take the form of a wooden shake shingle 64. The weather surface 66 of shingle 64 is formed from a wooden shake section 68. As is the case with ceramic tile 62, shingle 64 may optionally have a substrate 70 formed from a material different from wooden shake section 68.

The novel construction elements described above are preferably controlled by a novel controller electrically connected between one heating element 30 or 30A and an external source of electrical power. The novel controller includes a precipitation sensor and a temperature sensor, so that electrical power is connected to heating element 30 or 30A only when both subfreezing temperatures and presence of precipitation are sensed. The precipitation sensor includes a sampling receptacle 72, shown in FIG. 8. Receptacle 72 is open to the atmosphere and is fixed to the protected building (not shown) in a position to collect precipitation (not shown). The floor 74 of receptacle 72 contains two electrical terminals 76, 78 and a heating element 80. When precipitation is collected within receptacle 72, it is melted by heating element 80. In liquid form, the precipitation spans and connects terminals 76 and 78, thereby completing an electrical circuit.

Figure 9:
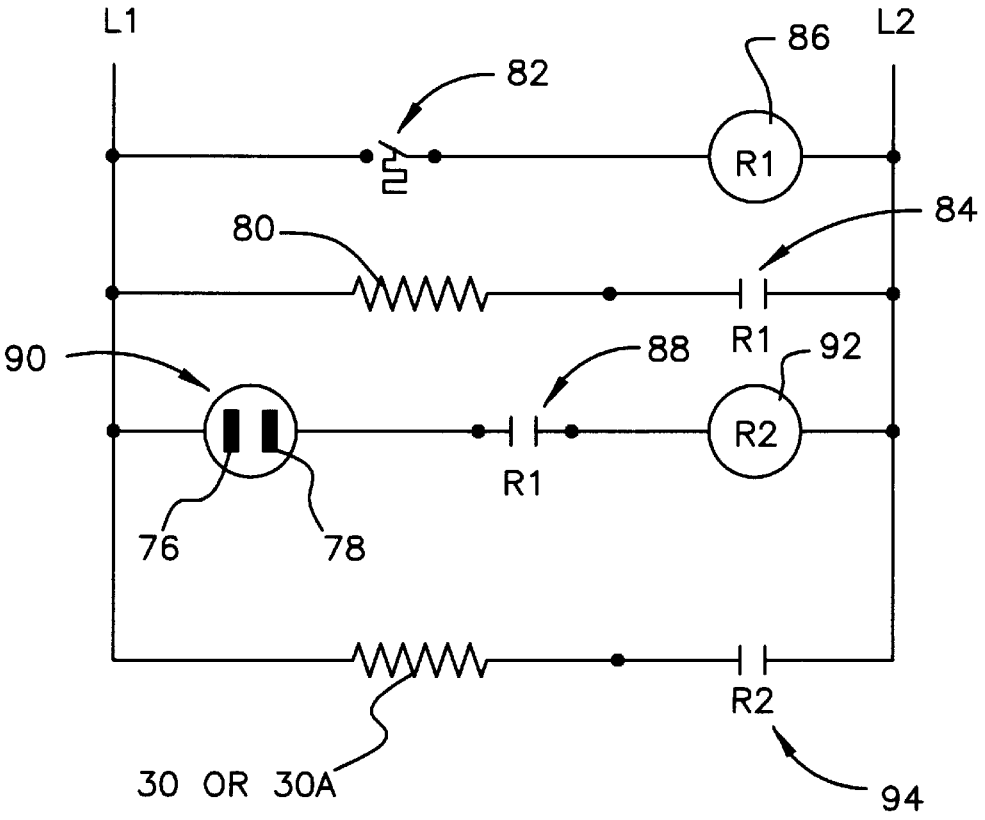
FIG. 9 is a diagrammatic electrical schematic illustrating operation of the controller partially depicted in FIG. 8.

Operation of the novel controller is fully set forth with reference to FIG. 9. Thermostat or temperature sensor 82 is connected between energized conductors L1 and L2 of an external power circuit. Associated contacts or switch associated with temperature sensor 82 close when a predetermined subfreezing temperature is attained, thereby energizing the coil 86 of a relay R1. Normally open contacts 84 of relay R1 connect power from the external power circuit to heating element 80 when the coil of relay R1 is energized. Normally open contacts 88 of relay R1 are disposed in series with a switch 90 formed by contacts 76 and 78. When contacts 88 and switch 90 both close, coil 92 of relay R2 is energized. Contacts 94 of relay R2 close, thereby connecting power to heating element 30 or 30A.

Figure 10:
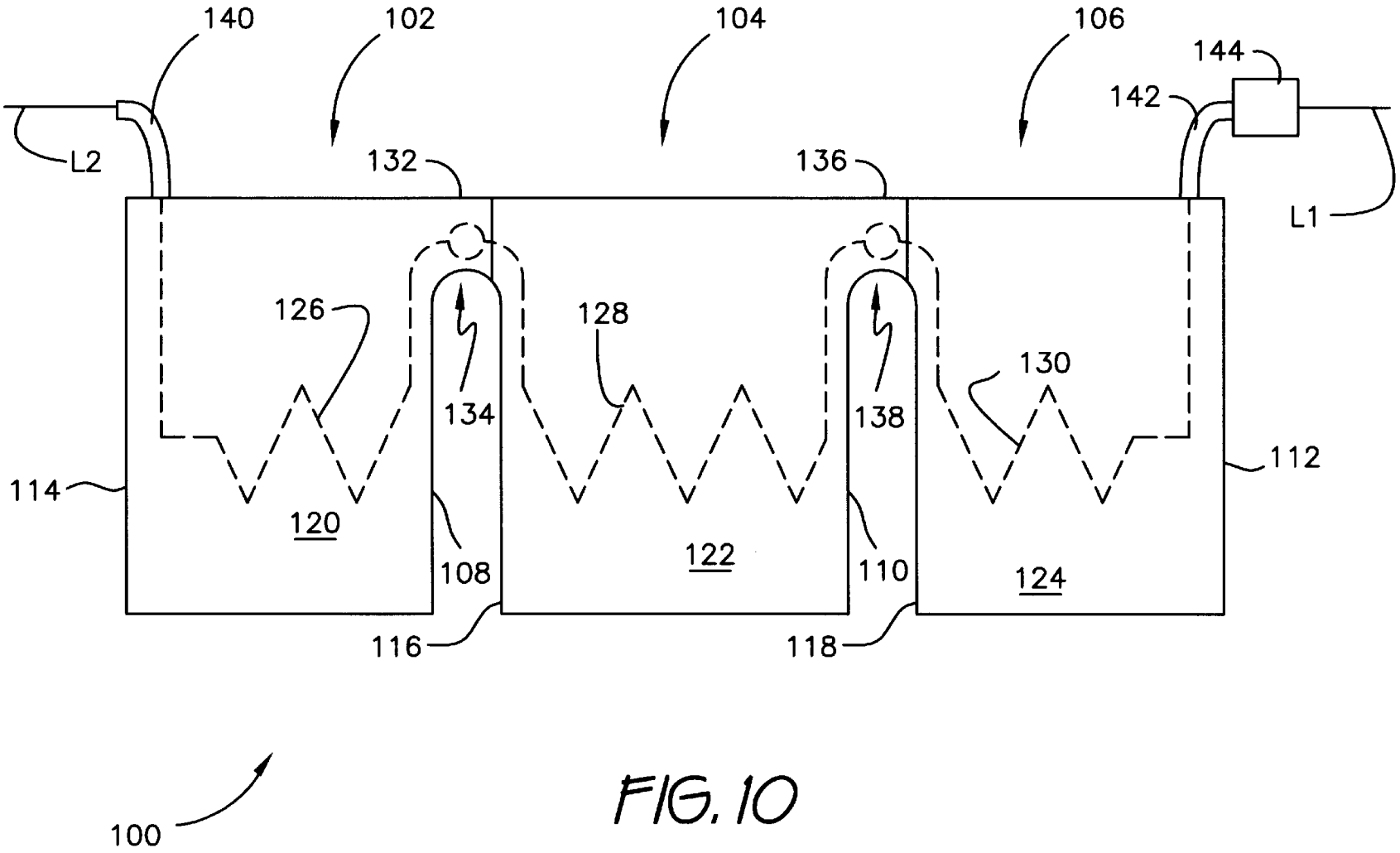
FIG. 10 is a top plan view of a modular kit of assembled individual novel construction elements including the controller of FIG. 9.

Referring now to FIG. 10, the invention may also be practiced as a modular kit 100 of mutually connectable self-heating roofing surface construction elements 102, 104, 106. Each construction element 102, 104, or 106 has a body having a right lateral edge 108, 110, or 112 (respectively), a left lateral edge 114, 116, or 118 (respectively), a weather surface 120, 122, or 124 formed from a weather resistant material, an electrical heating element 126, 128, or 130 (respectively) embedded within its associated body in underlying relationship to its associated weather surface 120, 122, or 124.

Construction element 102 is a first end module having a tab 132 projecting laterally from right edge 108. Construction element 104 is a center module having a tab 134 projecting laterally from left edge 116 and mating with tab 132 of element 102, and a tab 136 projecting laterally from right edge 110. Tab 136 mates with a tab 138 projecting laterally from left edge 118 of construction element 106. Each tab 132, 134, 136, or 138 contains at least one electrical conductor connected to a heating element 126, 128, or 130, in the manner of shingle 10 of FIG. 1.

Each construction element 102, 104, or 106 may have characteristics and features of asphaltic shingle 10, tile 62, or wooden shake shingle 64, as discussed above. Of course, it is preferred that all construction elements of modular kit 100 be of similar characteristics regarding appearance and type, with only tab characteristics differing among individual construction elements 102, 104, 106 of kit 100.

Figure 8:
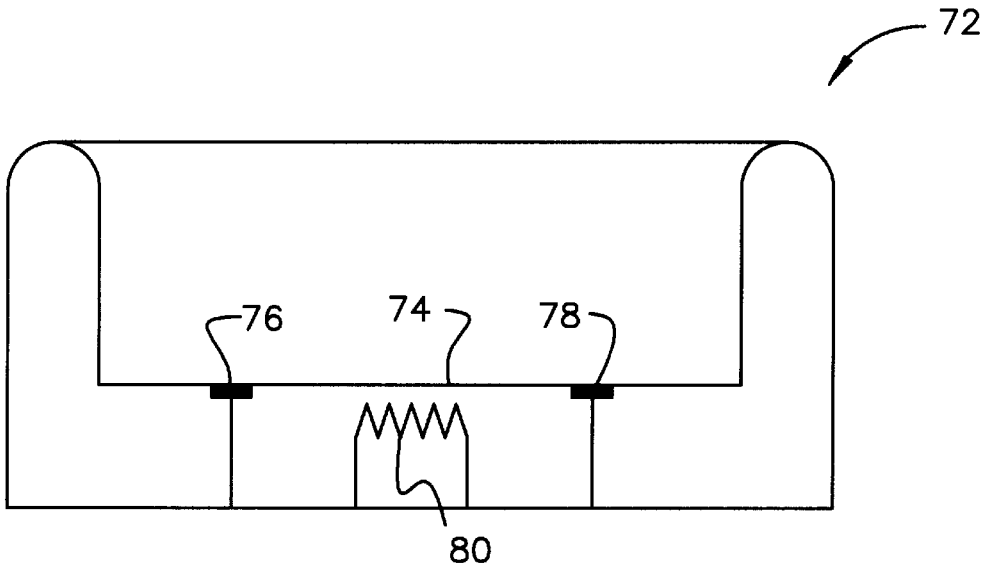
FIG. 8 is a cross sectional detail view of a component of a controller controlling electrical power to the invention.

Power may be connected to kit 100 after assembly by providing end modules 102, 106 with wire leads 140, 142 as shown. Preferably, a controller 144 having the features of that described with reference to FIGS. 8 and 9 is provided and electrically connected between assembled kit 100 and one leg L1 or L2 of the supply circuit.

The present invention is susceptible to variations and modifications which may be introduced thereto without departing from the inventive concept. The heating elements may be connected in series or may be of the self-contained type, and thus may include one or two conductors at each end. If desired, construction elements may be modified to include a third conductor, for example, a ground conductor.

With regard to tabs, center construction elements will have two tabs, either of which may include male or female terminals. Each tab may include one, two, or three conductors and associated terminals. Male terminals may be disposed upon either upper or bottom surface of the tab.

If desired, tabs may be located on a top or bottom edge of a construction element. This feature may be employed where an assembled modular kit is built from two rows of construction elements with one row above the other. The end modules of modular kit 100 would be replaced by corner modules having a laterally projecting tab and a tab projecting from the top or bottom edge.

Main power switches may break two legs of the supply circuit rather than one, if desired. This feature would be desirable in electrical supply circuits wherein the voltage of each leg differs in potential with neutral or ground, as commonly occurs in 240 volt, single phase residential circuits.

The precipitation sensor may operate on principles other than connection of two terminals by melted precipitation. For example, it may employ a capacitance based switch responsive to accumulation of water within the receptacle.

It is to be understood that the present invention is not limited to the embodiments described above, but encompasses any and all embodiments within the scope of the following claims.

I claim:

1. A self-heating roofing surface construction element comprising:

a generally planar body having a right lateral edge, a left lateral edge, a top weather surface formed from a weather resistant material and a bottom structural contact surface located on the opposite side from said top weather surface;

an electrical heating element embedded within said generally planar body between said top weather surface and said bottom structural contact surface;

a first tab located proximate said right lateral edge and a second tab located proximate said left lateral edge, said tabs projecting from said generally planar body, each said tab having at least one electrical conductor connected to said heating element, each said electrical conductor having a male terminal end and a female terminal end located oppositely said male terminal end and where said male terminal end of said electrical conductor extends past said top weather surface and said female terminal end extends past said bottom structural contact surface; whereby a plurality of said construction elements may be fitted in catenated fashion and a source of electrical power connected therewith.

2. The self-heating roofing surface construction element according to claim 1, further including a controller connected between one said heating element and an external source of electrical power, said controller including a temperature sensor including a first switch activated at a predetermined temperature and a precipitation sensor including a second switch activated in the presence of precipitation, where said first and said second switches are connected in series to provide electrical power to said heating element only when both the predetermined temperature and precipitation are sensed.

3. a self-heating roofing surface construction element comprising:

a generally planar body having a right lateral edge, a left lateral edge, a top weather surface formed from a weather resistant material and a bottom structural contact surface located on the opposite side from said top weather surface;

an electrical heating element embedded within said generally planar body between said top weather surface and said bottom structural contact surface;

a first tab located proximate said right lateral edge and a second tab located proximate said left lateral edge, said tabs projecting from said generally planar body, each said tab having at least one electrical conductor connected to said heating element, each said electrical conductor having a male terminal end and a female terminal end located oppositely said male terminal end and where said male terminal end of said electrical conductor extends past said bottom structural contact surface and said female terminal end extends past said top weather surface; whereby a plurality of said construction elements may be fitted in catenated fashion and a source of electrical power connected therewith.

4. The self-heating roofing surface construction element according to claim 3, further including a controller connected between one said heating element and an external source of electrical power, said controller including a temperature sensor including a first switch activated at a predetermined temperature and a precipitation sensor including a second switch activated in the presence of precipitation, where said first and said second switches are connected in series to provide electrical power to said heating element only when both the predetermined temperature and precipitation are sensed.

* * * * *